United States Patent [19]

Balmer et al.

[11] Patent Number: 4,797,315

[45] Date of Patent: Jan. 10, 1989

[54] DECORATIVE SURFACE COVERINGS WITH DOT PATTERNS

[75] Inventors: Richard H. Balmer, Manheim; Barbara A. Pfeiffer-Meshaw, Gordonville, both of Pa.

[73] Assignee: Armstrong World Industries, Inc., Lancaster, Pa.

[21] Appl. No.: 139,768

[22] Filed: Dec. 30, 1987

Related U.S. Application Data

[63] Continuation-in-part of Ser. No. 59,518, Jun. 8, 1987, abandoned.

[51] Int. Cl.[4] ..... B05D 5/06

[52] U.S. Cl. ..... 428/167; 428/168; 428/172; 428/173

[58] Field of Search ..... 428/156-173

[56] References Cited

U.S. PATENT DOCUMENTS

| | | | |
|---|---|---|---|
| 1,873,098 | 8/1932 | Young | 428/167 |
| 1,989,704 | 2/1935 | Lequillon | 428/167 X |
| 2,057,873 | 10/1936 | Atwood | 428/167 X |
| 2,366,209 | 1/1945 | Morris | 428/167 |
| 2,587,594 | 3/1952 | Chavannes et al. | 428/167 X |
| 3,305,381 | 2/1967 | van Wagener | 428/167 X |
| 3,804,657 | 4/1974 | Eyman et al. | 428/172 X |
| 3,810,813 | 5/1974 | Ellis | 428/172 |
| 3,931,429 | 1/1976 | Austin | 428/172 X |
| 3,958,043 | 5/1976 | McKee, Jr. et al. | 428/172 X |
| 4,068,030 | 1/1978 | Whitman | 428/172 X |
| 4,126,727 | 11/1978 | Kaninski | 428/172 |
| 4,214,028 | 7/1980 | Shortway et al. | 428/172 X |
| 4,320,163 | 3/1982 | Schwartz | 428/172 X |

*Primary Examiner*—Nancy A. B. Swisher

[57] ABSTRACT

A surface covering product is disclosed which comprises a substrate material, an impervious coating upon said material, and, raised transparent or translucent or opague colored elements printed upon said coating. The raised elements are formed as dot-shaped colored elements and comprise a thixotropic plastic. An opague colored material surrounds the raised elements and a dot-like colored pattern is formed. The substrate can be provided with a granular material layer and the dot-shaped elements are reversed and pressed into the granular material layer.

14 Claims, 2 Drawing Sheets

DECORATIVE SURFACE COVERINGS WITH DOT PATTERNS

CROSS-REFERENCE TO RELATED APPLICATION

The present application is a continuation-in-part of co-pending application Ser. No. 59,518, filed June 8, 1987, now abandoned.

BACKGROUND OF THE INVENTION

The present invention relates to a surface covering product. In particular, the present invention relates to a surface covering product comprising a substrate; a first impervious layer substantially covering said substrate; a second layer partially covering said first layer, said second layer comprising discrete colored raised portions of a thixotropic plastic material; and, a third colored layer filling in part of the area between the raised portions of the second layer.

The present invention relates also to a surface covering product comprising a substrate; a first sealing layer substantially covering said substrate; a second layer of granular material substantially covering said first sealing layer; and, a third layer partially covering and inserted into said second granular layer, said third layer comprising discrete inverted domeshaped colored portions of a thixotropic plastic material.

In the prior art, it is known to provide surface covering products having disposed thereon raised elements which contain particles of solid material. For example, U.S. Pat. No. 4,348,447 to Miller and Petzold shows non-skid plastic flooring structures in which inorganic particles are embedded in a cured plastic matrix in a substantially abutting relationship. Since the adhesive can be printed in a selective pattern, the raised elements give the appearance of an embossed-in register flooring material. Because such particles are applied to the adhesive surface of the matrix, however, particles applied in this manner typically do not penetrate uniformly throughout the plastic matrix. In addition, the number of particles is substantially lmiited and the particles must be covered over with a thin coating of clear plastic material to fully bond them to the material. In coating the particles with such a thin film, the underlying coating, interstitial to the raised elements, is coated also.

In the above reference, however, the raised elements, while they may have some decorative value per se, nevertheless do and would interfere with and obscure any underlying decoration, if such decoration were present. Further, such raised elements while useful for increasing wear resistance and slip resistance, create additional difficulties in the maintenance of the surfaces, and additional care must be taken in the maintenance of flooring employing such devices.

SUMMARY OF THE PRESENT INVENTION

It is an object of the present invention to provide a surface covering product having elements of enhanced decorative effect in a product without the maintenance difficulties typically associated with raised elements.

According to one embodiment of the present invention, there is provided a decorative surface covering product comprising: (a) a substrate; (b) a first impervious wear layer of a synthetic plastic polymeric material, said layer substantially covering one surface of said substrate; (c) a second colored layer partially covering said first wear layer, said second layer comprising discrete raised portions of a thixotropic plastic material; and (d) a third colored layer filling in part of the area between the raised portions of the second layer.

According to another embodiment of the present invention, there is provided a decorative surface covering product comprising: (a) a substrate; (b) a first sealing layer substantially covering one surface of said substrate; (c) a second layer of granular material substantially covering siad first sealing layer; and, (d) a third layer of discrete inverted dome-shaped colored portions partially covering and inserted into said second granular material, said discrete portions being a thixotropic plastic material.

DETAILED DESCRIPTION OF THE INVENTION

U.S. patent application Ser. No. 4,873, now U.S. Pat. No. 4,709,631, having a common assignee, shows a surface covering product comprising a substrate material, an impervious (non-porous) coating upon said substrate material, and raised elements selectively disposed upon said coating, which raised elements comprise a thixotropic plastic containing particles of solid material. The disclosure in this earlier application are hereby incorporated by reference as if set forth fully herein.

The raised elements disclosed in the above-cited application, however, are intended to increase the wear and slip resistance of the surface covering product. Other than providing a textured surface, it was not initially perceived that such raised elements could serve a significant decorative function. It has now, surprisingly, been found that such raised elements can serve as a design enhancement, creating unique visual effects.

Figure 1:
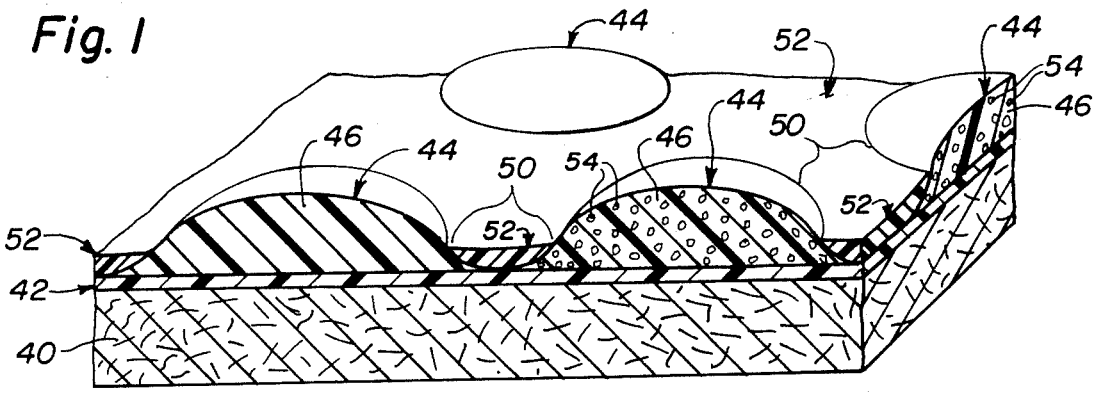
FIG. 1 shows a perspective view with a cross-sectional view of an embodiment of the present invention.

FIG. 1 shows an example in which one visual effect is particularly striking. In FIG. 1, an embodiment of the present invention is disclosed. In this embodiment, intended to be illustrative, an impervious coating (42) is provided on a substrate (40). In practice, coating (42) might be as simple as a sealant for a wet-laid felt or as complex as a multi-layered, multi-element construction. The practice of the present invention, in this or another embodiment, is not intended to be bound by the particular coating employed. Many coatings and coating methodologies are known to the art which would have application to the present invention, including foamable and non-foamable plastisols, resinous dry blends, stencil lay-ups and the like.

Colored raised elements (44) of a thixotropic plastic material (46) are then provided over the coating (42), and a wearlayer contrastingly colored coating (52) is provided over the interstitial areas (50). A dot pattern design of at least two colors is secured. One color is the exposed portion of the raised elements 44 and the other color is the coating 52. The elements 44 and coating 52 can be opaque, transulucent or transparent, but must be colored to provide the dot pattern design. The impervious coating 42 could contain a pigment and the color of that pigment could color the elements 44 or coating 52 if it is transparent and not colored itself.

Solid particles 54 are used in the raised element 44, but particular designs may choose not to employ such particles where the requirements for wear resistance are not as great. Further, the optional interstitial wear-layer coating (52) can vary in thickness and may, if desired, fill in up to about 30% to 95% of the level of the raised elements. The raised elements 44 display a color that contrasts the color of the coating 52 and the product has a visual appearance akin to a dot pattern floor.

Figure 2:
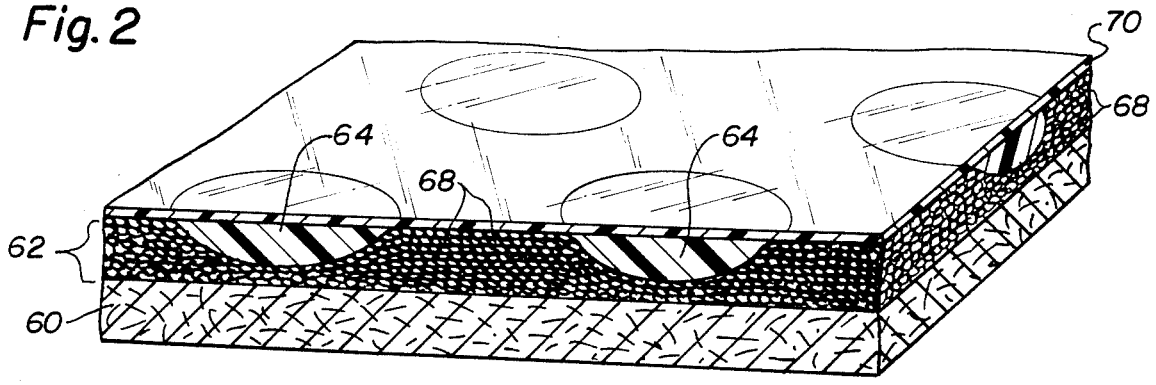
FIG. 2 shows a perspective view with a cross-sectional view of another embodiment of the present invention.

In FIG. 2 there is shown another example of the invention herein. Thr product shown in an upside-down version of the dots of the product of FIG. 1. A matrix (62) of small resin particles (68) typical of a stencil lay-up, are provided onto a substrate (60). This construction is then mated and consolidated with inverted raised elements (64) which have previously been cast on some type of strippable release carrier (70).

Where a release carrier is employed, the high-temperature distortion of the release coating can be employed to create or enhance a gloss differential between the surface area over the discrete portions and the surface over the interstitial fused resin particles. Such a surface gloss differential can be introduced in other ways, including formulation of the different resins (high gloss and low gloss resins). However, if the discrete portions of thixotropic plastic are first cast on a release carrier is then mated with a lay-up of resin particles and consolidated at a sufficiently elevated temperature, the areas of the release carrier uncoated by the thixotropic material will become distorted and leave a distorted image on the fused resin particles.

Figure 3:
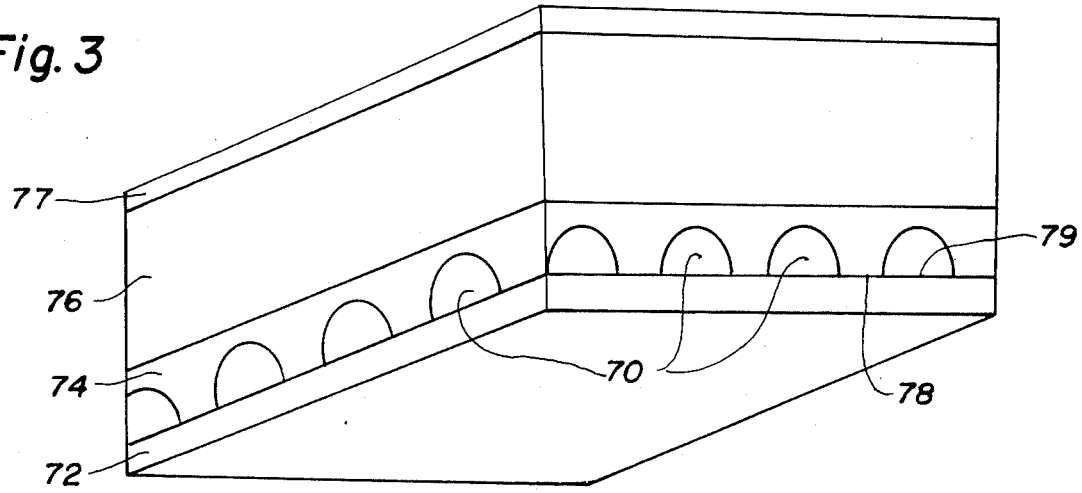
FIG. 3 shows a schematic view of another embodiment of FIG. 2.

The product shown in FIG. 3 is another upside down version of the dots of the product of FIG. 1. This product is formed by placing the dot pattern 70 of thixotropic material on a release carrier 72. A granular material 74 is deposited over the dot pattern to fill in the area between the dots and cover over the top or dome-shaped portion of the dots. The upper surface of the granular material is covered with a 40 mil layer 76 of non-foamable PVC plastisol or a 25 mil layer of foamable PVC plasticol (which foams to 50 mils). Over the PVC plastisol layer 76 is placed a tension or barrier coating 77, if desired. The coating 77 or coating 76, if coating 77 is not used, is the bottom of the floor product formed and is placed against the structural floor of a room. The release carrier 72 is stripped from the product and the surface 78 of layer 79, formed of the elements 70 and 74, becomes the decorative side of the floor product. The base of the dots in the dot pattern 74 forms a decorative pattern of circular dots with the areas around the dots colored by the granular material 74. The produce formed has a flat decorative surface 78 while the product of FIG. 1 had an irregular or nubb effect.

Figure 4:
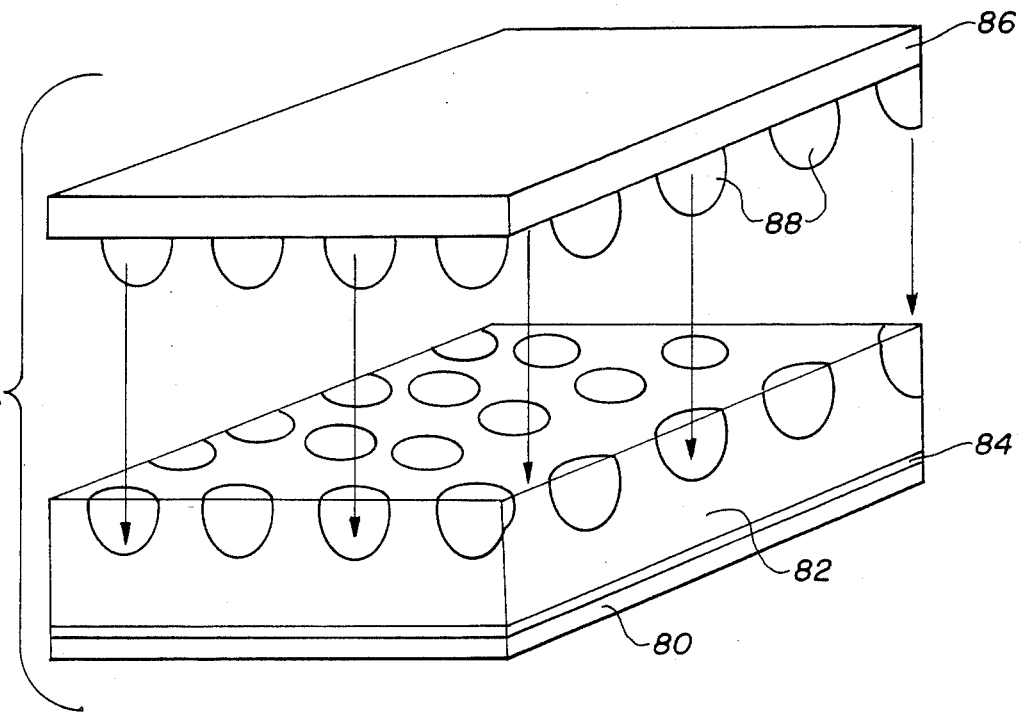
FIG. 4 shows an exploded schematic view of the product of FIG. 2.

In FIG. 4, there is shown another embodiment of the product in FIG. 2, formed in a different manner. A felt base or substrate 80 is provided with a granular material coating 82. If needed, a sealing layer 84 is provided to seal the surface of substrate 80 prior to receiving the granular material layer. A separate release carrier 86 is printed on its upper surface with a geometric pattern of raised dots of a thixotropic material 88. The carrier 86 is turned upside down, as shown in FIG. 4, and the downward facing side of the carrier with the dots is pressed into the upper surface of the granular material layer. The dots 88 may or may not have solid particles therein.

Figure 5:
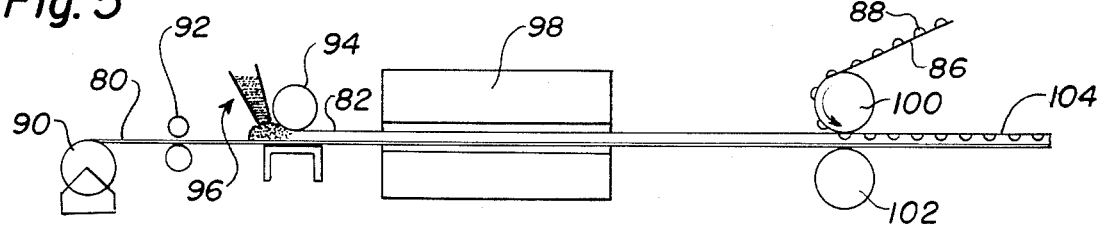
FIG. 5 shows a schematic drawing of a method of making the product of FIG. 4.

The method of making the embodiment of FIG. 4 is shown in schematic form in FIG. 5. The substrate 80 is unwound from a roll 90. A forward roll coater 92 applies a 3 mil wet smear coat of plastisol. The screed roll 94 levels out the granular material coating 82 which is deposited on the substrate by means 96. The substrate and granular material layer pass through the oven 98 to sinter or tack together the contacting surfaces of the granular material. The release carrier 86 with the raised dots of a thixotropic material 88 passes around a series of rollers and is positioned with the dots facing downward. Rolls 100 and 102 press the dots into the granular material layer 82 and the resultant product formed has a smooth surface 104 with the bases of the dots appearing on the surface 104. The granular material forms a design effect in the areas between the bases of the dots.

The Substrate

The present invention is not believed to be dependent on the substrate employed. Rather, it is believed that any of the substrates normally employed in the surface covering field can be employed in the practice of the present invention.

The substrate or backing sheet should be composed of strong, durable and flexible material. The backing can be woven, felted or a solid sheet of synthetic or natural flexible material. The conventional flexible flooring backing is a web of felted fibers. The felt generally is produced using a Fourdrinier or cylinder paper machine with the thickness of the resulting sheet being that usually used in floor and wall covering, that is, from 0.02 to 0.08 inch. A thickness of about 0.032 inch is usually preferred. The fibrous material used is normally cellulosic, although other fibers can be used including those of mineral and animal origin. The sources of cellulosic material can include cotton or other rag material, wood pulp including both ground wood and chemical wood pulp, paper, boxes, or mixtures thereof in any proportion. The web can also contain fillers, such as wood fiber.

The felt can be strengthened and improved in water resistance by impregnation with a bituminous material. Numerous bituminous materials are well-known as impregnants in the production of printed surface coverings and include asphalts of petroleum or tars and pitch residues of animal or vegetable origin. These materials can be treated to attain the desired physical properties of softening point or viscosity for satisfactory use by such treatment as air blowing, steam distillation, and the like.

The impregnant should be uniformly dispersed throughout the felt sheet. This can be controlled to some extent by the saturating technique through use of pressure rolls in the saturating bath. Where the impregnant is not uniformly dispersed throughout, blistering can frequently occur due to high concentrations of material adjacent to one surface of the felt.

If an impregnated backing sheet is used, it usually is provided with one or more seal coats, such as lacquer, prior to printing the decorative design. The seal coats perform the desirable function of masking the color of the felt and preventing the impregnant from bleeding through and staining the wear layer and, in addition, create a smooth uniform surface suitable as a base for printing. Felt sheets of the type commonly used as backings for printed surface coverings tend to have minor surface irregularities due to non-uniformities in the felt-making equipment. The sheet also frequently shows a number of small protruding lengths of fibers. The seal coats are designed to hide all these irregularities. The total thickness of seal coats required is normally from about 1 to about 12 mils. This thickness can be created through use of a single thick coating or several superimposed thinner coatings. Using the conventional techniques of coating, such as flexible doctor roller application, the desired thickness is created by use of more than one coating. The use of multiple coatings is also desirable in promoting optimum adhesion of the wear surface layer to the backing, since the seal coat applied directly to the fibrous backing can be designed for optimum sealing against migration of bituminous impregnant and the uppermost seal coat can be designed for optimum adhesion to the polyvinyl chloride surface wear layer.

Certainly, it is not envisioned that the present invention will be limited in anyway by the choice of substrate. In fact, although a substrate of some kind is normally required to provide necessary mechanical strength in processing, surface coverings are well known in which a strippable, release carrier is employed. Such a release carrier can then be removed from the surface covering product subsequent to the final fusion procedure. Such a strippable substrate is within the scope of the present invention.

Choices among available substrates, therefore, should be made on some basis such as manufacturing convenience or physical properties of the end product.

The Impervious Coating

Once a substrate is chosen and printed, it should be coated with a suitable impervious material. While it would be possible to apply the raised elements directly to a wet-laid felt, unless a plastic wear layer is applied to protect the interstitial felt, the product would have limited commercial value.

Of course, a glass mat substrate must be prepared with an impervious coating, usually a plastisol which may or may not be foamable, to impregnate the mat and seal the glass fibers.

As noted previously, the coating which must be employed may be as simple as a single layer or as complex as a multi-layered, multi-element construction. The practice of the present invention is not intended to be bound by the particular coating employed. Many coatings and coating methodologies are known to the art which would have application to the present invention, including, but by no means limited to, foamable and nonfoamable plastisols, resinous dry blends, stencil layups and the like.

The coating should, however, be impervious so that the thixotropic material deposited thereon remains on the surface to form a discrete element.

The impervious coating may be above the printed design, applied before the printing design or applied above and below the printed design.

The Granular Material

The granular layer is a board term used to describe any small particle resin material structure that is flowable in the manner of dry sand or a water/sand mix. One type of granular material is a plastisol slurry as used in Examples 1 or 2 wherein the granular material is a plastisol PVC resin material containing a high level of plasticizer. Another type of granular material is the classic dryblend as used in Example 4 wherein the granular material is formed of just vinyl resin particles with the plasticizer absorbed into the resin. Another type of granular material is a stencil mix of Example 3 wherein the granular material is formed of partially plasticized PVC filled particles. A granular material can be formed of a mixture of dryblend and stencil mix as done in Example 5. The composition of the granular material is not the important feature of its use herein. What is important is the granular material be formed of small particles and that the particles can be colored all one color or colored a number of different colors. A granular material could even be a plastisol (resin with diluent) with a high level of plasticizer so that it has a low viscosity.

The Raised Elements

Over the impervious coating discrete elements are created by depositing beads of a pseudoplastic thixotropic liquid which may contain solid particles. Such deposition can be carried out using various methods known to the art, however, screen printing, though normally employed to deposit inks on more porous surfaces, has been employed with good success.

The elements may be in any shape or pattern, however, geometrics such as repeated patterns of raised circles, squares, diamonds, and the like have been demonstrated to be effective visually.

The discrete elements may be from about three one-thousandths of an inch (0.003") to about eight one-hundredths of an inch (0.08") above the underlying construction, preferably from about fifteen one-thousandths of an inch (0.015") to about forty-five one-thousandths of an inch (0.045"), and most preferably, about three one-hundredths of an inch (0.03"). Further, such raised elements cover from about ten percent (10%) to fifty percent (50%) of the total surface area in the final product in order to provide an effective colored visual, with the exact percentage a function of the decorative material and the visual effect desired.

The Thixotropic Material

The present invention is made possible through the combination of an impervious coated substrate and the rheological characteristics of the plastic material applied. With an application methodology such as a rotary screen, a pseudoplastic thixotropic material can be deposited on the impervious coated substrate, typically in thicknesses excceeding that of normal printing inks. Because of the properties of the material, lateral flow can be controlled or substantially eliminated.

A thixotropic material is a material which exhibits dual rheological behavior, that is, they impart high viscosity to systems under low shear and low viscosity under high shear.

Fumed and precipitated silicas are probably the most often used thixotropic agents, or thixotropes, although various inorganic and organic materials are known to be operative, including such inorganic material as very fine particle, organophilic clays and such organic materials as high substituted sorbatols or calcium/ organic complexes. Fumed silicate, available commercially from the Degussa Company, under the trade designation Aerosil 200, has been employed to advantage.

The quantity of such material added to the resin paste system will determine the thixotropic nature of the resulting system, and its viscosities under various rates of shear. Such properties will determine the lateral flow of the plastisol deposited as raised elements on the substrate.

Various resinous materials may be employed as the thixotropic material in the present invention and these include virtually any useful resinous plastisols, while polyvinyl chloride resins have been employed with advantage.

To be useful in the practice of the present invention, sufficient thixotropic material must be present to enable the resin system to remain plastic under shear, losing its pseudoplastic characteristics rapidly when the shear force is removed.

The Particles

Although the thixotropic material can by itself provide the discrete elements of the surface covering product, abrasion properties of such surface covering will typically be greatly improved by the addition of solid particles. Such particles may be an inorganic material such as silica quartz or the like. These particles may be clear or slightly translucent.

In order to be useful as an abrasion resistive material in the present invention, the particles should be of suitable dimension to pass through a No. 10 U.S. Standard seive series mesh, a screen (U.S. Standard) with openings of about two millimeters (2.0 mm) and yet be retained on a No. 200 mesh screen (U.S. Standard), with openings of about seventy microns (70 u.m.). Preferred results, however, have been obtained with particles which would pass through a No. 25 mesh screen (U.S. Standard) with openings of about six hundred microns (600 u.m.) and be retained on a No. 50 mesh screen (U.S. Standard), with openings of about two hundred fifty microns (250 u.m.). The particles of solid material are of a MOHS hardness of 7 to 9, and preferably about 7.

The Final Coating

A final coating is applied to the product to fill in part of the area betwen the raised portions of the thixotropic material. This coating is normally colored or otherwise made opaque to conceal the design thereunder. It is possible that impervious coating could have a pigment therein or a color coating. The final coating and raised elements could, one at a time, be translucent or transparent. When the final coating or raised elements are translucent or transparent, the color of the impervious coating will color the final coating or raised elements. Whichever of the final coating or raised elements is being colored by the impervious coating, the other must be a contrasting color. The coating is of wear layer quality and can be any commercial wear layer material for flooring. It can be applied in one or more coatings.

EXAMPLE 1

A twenty-inch (20") wide portion of release paper was prepared for use as a substrate. First, the paper was coated with six mils (6 mils) of a nonfoamable PVC plastisol of a commercial formulation, which was gelled in contact with a drum heated to 300° F. Then this compact layer was itself coated with twenty-five mils (25 mils) of a foamable PVC plastisol of a commercial formulation, and gelled in a hot air oven at 290° F. for 1½ minutes. This formed the impervious coating. A decorative image in the form of a screen printed plastisol was applied over the material prepared in the above manner. The formulation of the plastisol employed was:

| | | Weight Percent |
|---|---|---|
| Primary Plasticizer | Dioctyl Phtalate | 12.9 |
| Plasticizer | Texanol Isobutyrate TXIB | 12.9 |
| Stabilizer/Plasticizer | Epoxidized Soya Oil | 1.5 |
| Stabilizer | Synpron 1522 | 1.3 |
| Maleic Acid Ester | Perenol E-2 | 1.9 |
| Surfactant | Surfynol 104-A | 1.3 |
| PVC Resin | Tenneco 1734 | 18.6 |
| PVC Resin | Geon 179 | 32.8 |
| PVC Resin | Geon 213 | 12.8 |
| Fumed Silica | Aerosil 200 | 0.6 |
| Pigment | Titanium Dioxide | 3.4 |
| | | 100.0 |

By use of the amount of plasticizer, the viscosity was adjusted to between 110 poise to 130 poise.

The printed image of raised elements was gelled in a hot air oven at about 270° F. for 1½ minutes which conditions were chosen to avoid expansion of the foam.

A knife over roll coater was then used to apply a plastisol slurry to fill in and around the raised printed dot image of the previous plastisol as a final coating. This plastisol slurry was comprised of:

| | | Weight Percent |
|---|---|---|
| Plasticizer | Texanol Iosbutyrate TXIB | 13.0 |
| Stabilizer/Plasticizer | Epoxidized Soya Oil | 1.5 |
| Plasticizer | Nuoplaz 6000 | 13.0 |
| Stabilizer | Synpron 1522 | 1.3 |
| Maleic Acid Ester | Parenol E-2 | 2.0 |
| Surfactant | Surfynol 104-A | 1.3 |
| PVC Resin | Tenneco 1734 | 18.8 |
| PVC Resin | Geon 179 | 33.3 |
| PVC Resin | Geon 213 | 13.0 |
| Pearl Pigment | Afflair 163 | 2.8 |
| | | 100.0 |

The material prepared in this manner was then blown and fused in a high temperature oven at 380° F. for 1½ minutes. The resulting surface covering had a unique visual appearance showing an overall geometric pattern with a subtle nubby texture.

EXAMPLE 2

The product formed in Example 1 was formed herein wherein the following plastisol was used for forming the raised elements:

| | | Weight Percent |
|---|---|---|
| Primary Plasticizer | Dioctyl Phthalate | 14.55 |
| Plasticizer | Texanol Isobutyrate TXIB | 8.70 |
| Stabilizer/Plasticizer | Epoxidized Soya Oil | 1.62 |
| Stabilizer | Zinc Neodecanoate | .30 |
| Stabilizer | Barium Neodecanoate | .51 |
| Viscosity Depressant | Solvent BYK 4015 | 1.49 |
| PVC Resin | Borden 26055 | 14.55 |
| PVC Resin | Tenneco 1734 | 21.69 |
| PVC Resin | Hooker 6337 | 36.23 |
| Fumed Silica | Aerosil 200 | .36 |
| | | 100.00 |

The above may be with or without quartz. If quartz is added, it should be sieved through a 30/50 mesh screen and added at a rate of 15% by weight. By the use of the amount of plasticizer, the viscosity was adjusted to between 110 poise to 130 poise. If pigment is added, it is added at the desired rate per 100 lbs. of plastisol.

The following plastisol slurry was used as a final coating:

| | | Weight Percent |
|---|---|---|
| Primary Plasticizer | Dioctyl Phthalate | 15.35 |
| Plasticizer | Texanol Isobutyrate | 15.82 |
| Stabilizer/Plasticizer | Epoxidized Soya Oil | .67 |
| Stabilizer | Barium, Zn, Phosphite H + N 406 | 1.21 |
| Resin PVC | Hooker 6337 | 46.86 |
| PVC Resin | Goodyear M-70 | 20.09 |
| | | 100.00 |

The product was formed by the same process as set forth for Example 1 and the above plastisol and plastisol slurry were substituted for the like material of Example 1.

EXAMPLE 3

A quantity of plastisol was prepared of the following materials:

| | | Weight Percent |
|---|---|---|
| Primary Plasticizer | Dioctyl Phthalate | 13.97 |
| Plasticizer | Texanol Isobutyrate TXIB | 9.40 |
| Stabilizer/Plasticizer | Epoxidized Soya Oil | 1.55 |
| Stabilizer | Zinc Neodecanoate (8%) | 0.29 |
| Stabilizer | Barium Neodecanoate (15%) | 0.49 |
| Viscosity Depressant | Byk 4015 | 1.43 |
| Surfactant | Surfynol 104-A | 2.78 |
| PVC Resin | Goodyear M-70 | 20.88 |
| PVC Resin | Hooker 6337 | 48.72 |
| Fumed Silica | Aerosil | 0.49 |
| | | 100.00 |

To this plastisol was added the following:

| | |
|---|---|
| Yellow GR Pigment Paste | Trace |
| Carbon Black Pigment Paste | Trace |
| Synthetic Iron Oxide Pigment Paste | Trace |

Finally, to this mixture, a quantity of Quartz particles which fell between 30 and 50 mesh screens and representing about 13.04 percent by weight were added. The initial viscosity as measured with a Brookfield Viscometer using a No. 6 spindle at 20 revolutions per minute, was about 130 poise, but rose to approximately 160 poise. A small additional portion of isobutyrate plasticizer was added, as needed, to adjust the viscosity to between about 100 poise and 110 poise.

The plasticol prepared in this manner was then rotary screen printed in a pattern of small dots onto a release paper carrier and fused by passing through two air impingement ovens heated at 390° F. at a line speed of twenty feet per minute (20 ft./min.).

An overall lay-up of fine grind, mottled stencil vinyl fines, i.e. partially plasticized polyvinyl chloride particles having a particle size which allowed them to pass through a standard 20 Mesh U.S. Sieve, was applied to a coated flooring felt with a grid-type stencil. The release paper with the printed dot image was mounted on an unwind stand and the printed side of the paper was brought into contact with the stencil mix. As the felt and stencil fines were carried into a press, the printed dot image was transferred and pressed into the underlying stencil vinyl mix in a consolidation employing a double press and pad set up with a twelve second dwell time. The top platen of the press was heated to between 290° F. and 295° F., and the bottom platen was heated to 250° F., the press subjected the sample to a pressure of about 200 to 220 pounds per square inch.

The material was then repressed with an embossing plate. The top plate was run at 290° F. with an unheated bottom platen, and the dwell time was seven seconds, while the press subjected the sample to a pressure of about 1,100 pounds per square inch.

The release paper was then stripped away leaving the plastisol dots as part of the consolidated flooring structure.

EXAMPLE 4

A quantity of plastisol was prepared of the following materials:

| | | Weight Percent |
|---|---|---|
| Primary Plasticizer | Dioctyl Phthalate | 13.97 |
| Plasticizer | Texanol Isobutyrate TXIB | 9.40 |
| Stabilizer/Plasticizer | Epoxidized Soya Oil | 1.55 |
| Stabilizer | Zinc Neodecanoate (8%) | 0.29 |
| Stabilizer | Barium Neodecanoate (15%) | 0.49 |
| Viscosity Depressant | Byk 4015 | 1.43 |
| Surfactant | Surfynol 104-A | 2.78 |
| PVC Resin | Goodyear M-70 | 20.88 |
| PVC Resin | Hooker 6337 | 48.72 |
| Fumed Silica | Aerosil | 0.49 |
| | | 100.00 |

To this plastisol was added the following:

| | |
|---|---|
| Yellow GR Pigment Paste | Trace |
| Carbon Black Pigment Paste | Trace |
| Synthetic Iron Oxide Pigment Paste | Trace |

Finally, to this mixture, a quantity of Quartz particles which fell between 30 and 50 mesh screens and representing about 13.04 percent by weight were added. The initial viscosity as measured with a Brookfield Viscometer using a No. 6 spindle at 20 revolutions per minute, was about 130 poise but rose to approximately 160 poise. A small additional portion of isobutyrate plasticizer was added, as needed, to adjust the viscosity to between about 100 poise and 110 poise.

The plastisol prepared in this manner was then rotary screen printed in a pattern of small dots onto a release paper carrier and fused by passing through two air impingement ovens heated at 390° F. at a line speed of twenty feet per minute (20 ft./min.).

There is placed on a felt base an overall layup of dryblend as follows:

| | | Weight Percent |
|---|---|---|
| PVC Resin | Pevikon S-658 | 69.0 |
| Plasticizer | Butyl Benzyl Phtlalate S-160 | 27.5 |
| Stabilizer | Modified Dibutyltin Maleate M275 | 1.5 |
| Pigment | | 2.0 |
| | | 100.0 |

The release paper with the printed dot image was mounted on an unwind stand and the printed side of the paper was brought into contact with the dryblend. As the felt and dryblend were carried into a roll laminator, the printed dot image was transferred and pressed into the underlying dryblend. The laminator was heated to 220° F. to 250° F. and applied a pressure of 320 lbs. per square inch

EXAMPLE 5

A quantity of plastisol was prepared of the following materials:

| | | Weight Percent |
|---|---|---|
| Primary Plasticizer | Dioctyl Phthalate | 13.97 |
| Plasticizer | Texanol Isobutyrate TXIB | 9.40 |
| Stabilizer/Plasticizer | Epoxidized Soya Oil | 1.55 |
| Stabilizer | Zinc Neodecanoate (8%) | 0.29 |
| Stabilizer | Barium Neodecanoate (15%) | 0.49 |
| Viscosity Depressant | Byk 4015 | 1.43 |
| Surfactant | Surfynol 104-A | 2.78 |
| PVC Resin | Goodyear M-70 | 20.88 |
| PVC Resin | Hooker 6337 | 48.72 |
| Fumed Silica | Aerosil | 0.49 |
| | | 100.00 |

To this plastisol was added the following:

| | |
|---|---|
| Yellow GR Pigment Paste | Trace |
| Carbon Black Pigment Paste | Trace |
| Synthetic Iron Oxide Pigment Paste | Trace |

Finally, to this mixture, a quantity of Quartz particles which fell between 30 and 50 mesh screens and representing about 13.04 percent by weight were added. The initial viscosity was measured with a Brookfield Viscometer using a No. 6 spindle at 20 revolutions per minute, was about 130 poise but rose to approximately 160 poise. A small additional portion of isobutyrate plasticizer was added, as needed, to adjust the viscosity to between about 100 poise and 110 poise.

The plastisol prepared in this manner was then rotary screen printed in a pattern of small dots onto a release paper carrier and fused by passing through two air impingement ovens heated to 390° F. at a line speed of twenty feet per minute (20 ft./min.).

An overall lay-up of a 20%/80% dryblend/stencil vinyl mix was applied to a coated flooring felt with an open grid stencil. The release paper with the printed dot image was mounted on an unwind stand and the printed side of the paper was brought into contact with the stencil mix. As the felt and dryblend were carried into a press, the printed dot image was transferred and pressed into the underlying dryblend/stencil vinyl mix matrix. A two-press operation was employed with the first press at 295° F. at 900 lbs. pressure psi with pressing time of 8 seconds. The second press was at 270° F. at 1,200 psi and pressing time of 6 seconds.

What is claimed is:

1. A decorative surface covering product comprising:
(a) a substrate;
(b) a first impervious layer of a synthetic plastic polymeric material, said layer bonded to at least one surface of said substrate;
(c) a second layer partially covering said first layer, said second layer comprising discrete raised portions of a cured thixotropic plastic material forming raised elements extending upwardly therefrom with depressed areas around the raised elements; and
(d) a third layer filling in part of the depressed areas whereby the raised elements and third layer form a colored dot pattern on a contrasting colored background.

2. The decorative surface covering product of claim 1 wherein the first impervious layer is comprised, in substantial part, of colored resin particles.

3. The decorative surface covering product of claim 2 wherein the second layer comprises raised discrete dot-shaped transparent elements which are positioned on the first impervious layer and said raised elements are preferably 0.015 to 0.045 inches in height at the center of the raised shape.

4. The decorative surface covering product of claim 3 wherein the raised discrete elements form a representitive pattern with the raised portions covering substantially 10 to 50 percent of the first layer with the color of the first layer appearing as the color of the raised elements and the third layer is a contrasting colored layer.

5. The decorative surface covering product of claim 1 wherein the second layer is formed with colored discrete raised portions and the third layer is a contrasting color.

6. The decorative surface covering product of claim 1 wherein the raised discrete portions contain solid particles of a MOHS hardness of at least 7 and a diameter size of 600 microns or less.

7. The decorative surface covering product of claim 6 wherein the thixotropic plastic material contains at least one thixotrope chosen from the group consisting of fumed silicas, precipitated silicas, finely powdered organophilic clays, highly substituted sorbatrols and calcium/organic complexes.

8. The decorative surface covering product of claim 1 wherein the third layer fills in about 30 to 95 percent of the depressed areas around the raised elements.

9. A decorative surface covering product comprising:
(a) a substrate;
(b) a layer of fused granular material substantially covering said substrate and bonded thereto; and
(c) a layer of discrete inverted domed-shaped raised elements extending completely into the layer of granular material.

10. The decorative surface covering product of claim 9 wherein the decorative surface of the granular material, opposite to the surface thereof bonded to the substrate, has the inverted dome-shaped raised elements extending thereinto so that the domed-shaped elements are visible on the decorative surface of the granular material whereby the raised elements form a dot design on the decorative surface of the granular material.

11. The decorative surface covering product of claim 10 wherein the decorative surface of the granular material appears as a single color.

12. The decorative surface covering product of claim 10 wherein the decorative surface of the granular material appears as particles of different colors.

13. The decorative surface covering product of claim 10 wherein the discrete raised elements are colored and arranged in a dot patern design and, when positioned within the colored granular layer but visible on the decorative surface thereof, the dot pattern design of the raised elements provide the decorative surface of the granular layer with a discrete colored dot pattern of a contrasting color to the color of the granular layer.

14. The decorative surface covering product of claim 10 wherein the raised elements have a domed-shaped top and a circular cross-section base and the domed-shaped top extends well below the decorative surface of the granular material while the circular cross-section base is in the plane of the decorative surface of the granular material.

* * * * *